US006784393B2

(12) United States Patent
Bach et al.

(10) Patent No.: US 6,784,393 B2
(45) Date of Patent: Aug. 31, 2004

(54) ARC QUENCHING DEVICE FOR LOW-VOLTAGE SWITCHING DEVICES

(75) Inventors: Michael Bach, Berlin (DE); Guenter Seidler-Stahl, Berlin (DE); Sezai Tuerkman, Berlin (DE); Detlev Schmidt, Berlin (DE); Ingo Thiede, Berlin (DE); Artur Wajnberg, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/256,187

(22) Filed: Sep. 27, 2002

(65) Prior Publication Data

US 2003/0062341 A1 Apr. 3, 2003

(30) Foreign Application Priority Data

Sep. 28, 2001 (DE) ..... 101 49 019

(51) Int. Cl.[7] ..... H01H 33/02

(52) U.S. Cl. ..... 218/153; 218/35; 218/153; 335/201

(58) Field of Search ..... 218/153, 34, 35, 218/36, 38–40, 149–151, 154–158, 159, 147; 335/201, 202

(56) References Cited

U.S. PATENT DOCUMENTS

| | | | | | |
|---|---|---|---|---|---|
| 4,982,174 | A | * | 1/1991 | Fasano | 218/151 |
| 5,731,561 | A | * | 3/1998 | Manthe et al. | 218/35 |
| 5,889,249 | A | * | 3/1999 | Rival et al. | 218/149 |
| 6,191,377 | B1 | * | 2/2001 | Roesner et al. | 218/149 |

FOREIGN PATENT DOCUMENTS

| | | | |
|---|---|---|---|
| DE | 3541514 | 5/1987 | |
| DE | 29807119 | 7/1998 | |
| WO | WO 99/50867 | * 10/1999 | H01H/9/34 |

* cited by examiner

*Primary Examiner*—Lincoln Donovan
*Assistant Examiner*—M. Fishman
(74) *Attorney, Agent, or Firm*—Harness, Dickey & Pierce, P.L.C.

(57) ABSTRACT

An arc quenching device for an air-switching low-voltage switching device includes quenching plates, which are arranged between and attached to parallel insulating walls, as well as a cover. A separate cooling device may be introduced into the space between the quenching plates and the cover. The cooling device is in the form of an insert cartridge and contains deionization technology for switching gases. Attachment pins on the cooling device and corresponding holding openings on the inside of the cover make it possible to fit the cooling device to the cover before this cover engages with the insulating walls.

16 Claims, 3 Drawing Sheets

ARC QUENCHING DEVICE FOR LOW-VOLTAGE SWITCHING DEVICES

This application hereby claims priority under 35 U.S.C. §119 on German Patent Application DE 10149019.4, filed Sep. 28, 2001, the entire contents of which are herein incorporated by reference.

FIELD OF THE INVENTION

The invention generally relates to an arc quenching device for an air-switching low-voltage switching device, having a quenching chamber which has quenching plates and having a cover. The cover covers the quenching chamber and is provided with outlet openings for switching gases, as well as having an optionally usable, separate cooling device, which has deionization technology, for the switching gases.

BACKGROUND OF THE INVENTION

Air-switching low-voltage switching devices, such as low-voltage circuit breakers, require, for operation, an arc quenching device, in the form of quenching chambers for cooling and quenching switching arcs, which occur when the contacts separate. In order to prevent any adverse effect on the circuit breaker itself or on adjacent system parts or other assemblies, the switching arcs must be kept away from other components in the circuit breaker, and the hot and thus ionized switching gases must be cooled sufficiently, before they emerge from the quenching chamber, so that no electrical flashovers or other damage occur or occurs in the vicinity of the switching device. Every arc quenching chamber normally contains a large number of quenching plates, which are arranged between two side walls and contribute to the cooling and quenching of the arc. A cover with outlet openings for switching gases is located above the quenching plates.

The locations in which low-voltage circuit breakers are stored may differ widely. This governs the temperature and the extent of ionization that the switching gases which emerge from the arc quenching devices may have. In order to take account of these different conditions, arc quenching devices are produced in a normal version for standard requirements and, if required, may have a separate cooling device for the switching devices added to them. In this case, it is possible for a requirement for improved cooling of the switching gases to be discovered only after a switchgear assembly is installed, for example on the basis of a change in the method of operation or as a result of the use of different loads, with the result that switching operations occur at a higher power level, and with a correspondingly greater amount of switching gases.

According to DE 35 41 514 C2, the additional cooling device includes an attachment for each of the quenching chambers in a circuit breaker. Each attachment has a frame-like housing body and deionization technology, arranged in this housing body, in the form of wire mesh, quenching plates or the like. The advantage of simple retrospective fitting of such a separate cooling device must be traded off against the height of the circuit breaker being increased by the separate cooling device. It is thus possible for a situation to occur in which separate cooling devices cannot be fit retrospectively, because there is insufficient space in the switchgear cubicle.

SUMMARY OF THE INVENTION

An object of an embodiment of the invention is to provide an arc quenching device having an additional cooling device which can be installed when required and which does not increase the physical volume of the circuit breaker.

According to an embodiment of present invention, the object is achieved in that a separate cooling device is in the form of a frame for accommodating deionization technology and may be designed to be suitable for installation in the interior of the arc quenching device, between the quenching plates and the cover, with the quenching plates and the cover being supported by common, parallel insulating walls.

It is already known from DE 298 07 119 U1 for a cooling device, which is referred to as a damping insert, for switching gases to be arranged in the space between a arc splitter stack and a quenching chamber cover. This damping insert is held on the cover by way of a screw which connects two cover parts, which can move relative to one another, and contains the female thread for the screw. The relevant arc quenching device can thus not be used without the cooling device. In contrast, on the basis of an embodiment of the invention, arc quenching devices may optionally be used with or without a separate cooling device.

For the purposes of an embodiment of the invention, the cooling device may have a covering panel and a base panel added to it to form an insert cartridge, which forms a cavity for the introduction of the deionization technology, with aperture openings for the switching gases being provided in the covering panel and in the base panel. This configuration results in the cooling device being in a form which is suitable for retrofitting as required. At the same time, this form offers the capability to influence the cooling effect independently of the deionization technology, which are provided, by way of example, in the form of metal meshes or metal sieves. This may be done by the aperture openings having a circular or polygonal cross section, or by them being in the form of slots.

The fitting of the cooling device can be further assisted by the cooling device as well as the cover of the arc quenching device being provided with interacting attachment devices on their side facing the quenching plates, and by the cooling device being fit to the inside of the cover, by way of the attachment devices, if required before the cover is installed on the arc quenching device. Interlocking attachment devices are suitable in a preferred manner for this purpose, for example in such a way that the attachment devices are in the form of holding openings in the cover of the arc quenching device and attachment pins, which are arranged on the covering panel of the insert cartridge and are intended for insertion into said holding openings. In this case, the dimensions of the holding openings and of the attachment pins are expediently matched to one another such that, when the attachment pins are inserted into the holding openings, a friction fit is produced in order to secure them against sliding out. This can be achieved by the attachment devices for producing the friction lock being slotted and sprung.

The attachment devices for the cooling device may also be in the form of molded attachments and guide rails, which originate from them, for insertion of the cooling device, which is in the form of an insert cartridge.

As already mentioned, DE 298 07 119 U1, discloses a method of construction for arc quenching devices, in which the quenching plates are arranged between parallel insulating walls and are attached to them, such that a cohesive arc splitter stack is formed. This method of construction is also suitable for arc quenching devices according to the invention, in which case it has been found to be advantageous for the quenching plates and the cover to be attached to common insulating panels, which are arranged parallel to one another and hold the quenching plates and the cover between them, with webs which point outward being arranged on molded attachments on the cover, and slots which hold the webs being arranged in the insulating panels. This ensures that intended distances are maintained between the ends of the quenching plates, the cooling device and the cover at all times, and thus at the same time ensuring the flow resistance for switching gases and other important parameters.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
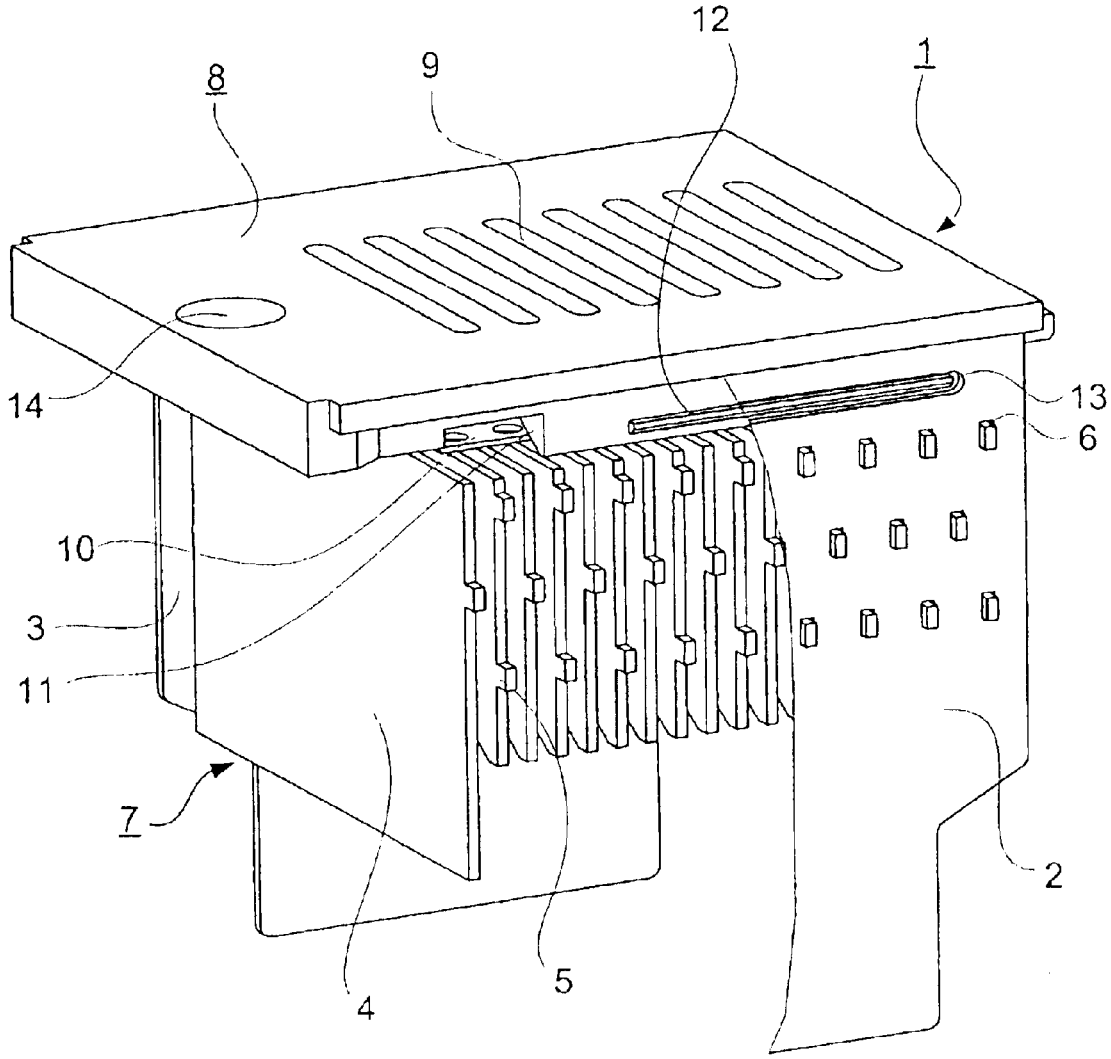
FIG. 1 shows a perspective view, partially in the form of a section, of one embodiment of an arc quenching device according to the invention.

FIG. 1 shows a perspective view, partially in the form of a section, of one embodiment of an arc quenching device 1 according to the present invention. The arc quenching device 1 includes insulating walls 2, 3 composed of fiber or fire-resistant plastic, and quenching plates 4 with pins 5, which are inserted into holes 6 in the insulating walls 2, 3, and are swaged. This results in an arc splitter stack 7, which is inserted into the quenching chamber, which is integrated in the switch housing. It also has a sealing cover 8, which is of simple design with blow-slots 9, and is provided with an insert cartridge 10 on its inside, as additional protection against the emergence of hot gases and particles.

This insert cartridge 10 is attached by way of a prepared holder to the inside of the cover 8 of the arc quenching device 1. Molded attachments 11 are provided on the cover 8 of the arc quenching device 1 and have projecting webs 12 which are arranged at the sides and engage in slots 13 in the insulating walls 2, 3 of the arc splitter stack 7.

An aperture opening 14 is provided in the cover 8 of the arc quenching device 1 for an attachment screw, which is not illustrated but by way of which the arc quenching device 1 is mounted in the integrated quenching chamber of the switching device.

Figure 2:
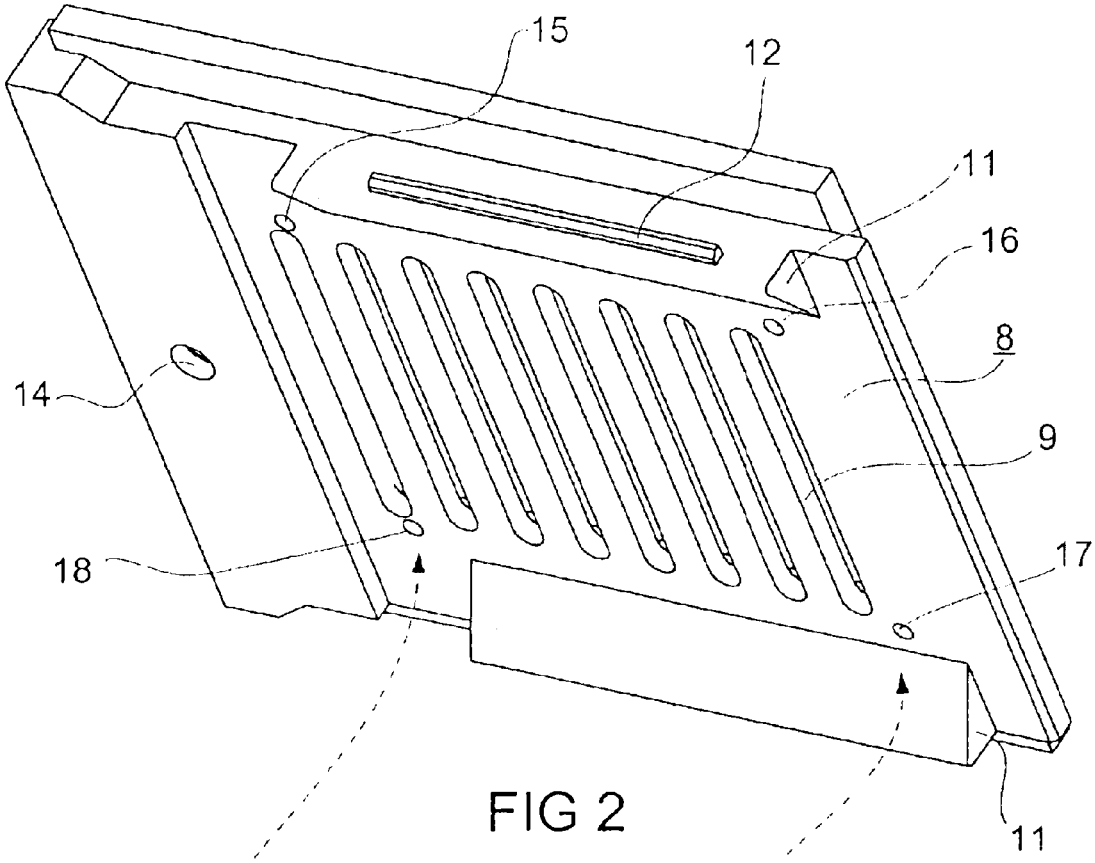
FIG. 2 shows a perspective view of a first embodiment of a cover for an arc quenching device according to the invention.

FIG. 2 shows a perspective view of a first embodiment of a cover 8 for an arc quenching device 1 according to the invention. This has output openings 9, an aperture opening 14 for an attachment screw which is not illustrated, molded attachments 11 with projecting webs 12 which are arranged at the sides on it, for engaging in slots 13 in the insulating walls 2, 3 of the arc splitter stack 7, and holding openings 15, 16, 17, 18, into which attachment pins 19, 20, 21, 22 (FIG. 3) can be inserted. The molded attachments 11, which are used for holding the projecting webs 12, have a triangular cross section, such that they form a guide when the insert cartridge 10 is being inserted.

Figure 3:
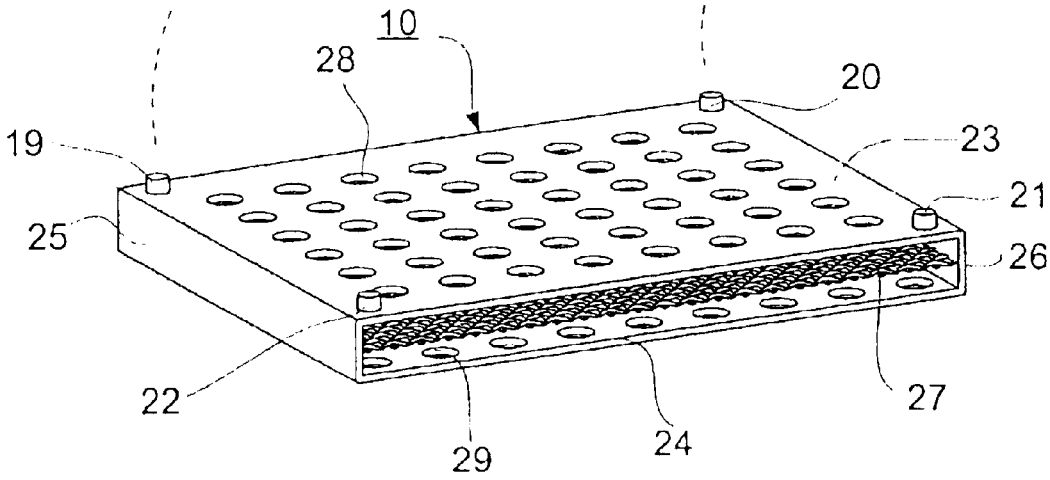
FIG. 3 shows a perspective view of a first embodiment of an insert cartridge for an arc quenching device according to the invention.

FIG. 3 shows a perspective view of a first embodiment of an insert cartridge 10 for an arc quenching device 1 according to the invention. The insert cartridge 10 includes a covering panel 23, a base panel 24 and side walls 25, 26, which form a cavity for the insertion of metal sieves 27 as deionization technology. Aperture openings 28; 29 are provided in the flow direction of the switching gases in the covering panel 23 and in the base panel 24, and have a circular cross section. Attachment pins 19, 20, 21, 22 are also arranged on the covering panel 23 and, when the insert cartridge 10 is being installed, are inserted into the holding openings 15, 16, 17, 18 in the cover 8 of the arc quenching device, as is indicated by the dash-dash-dotted lines.

Figure 4:
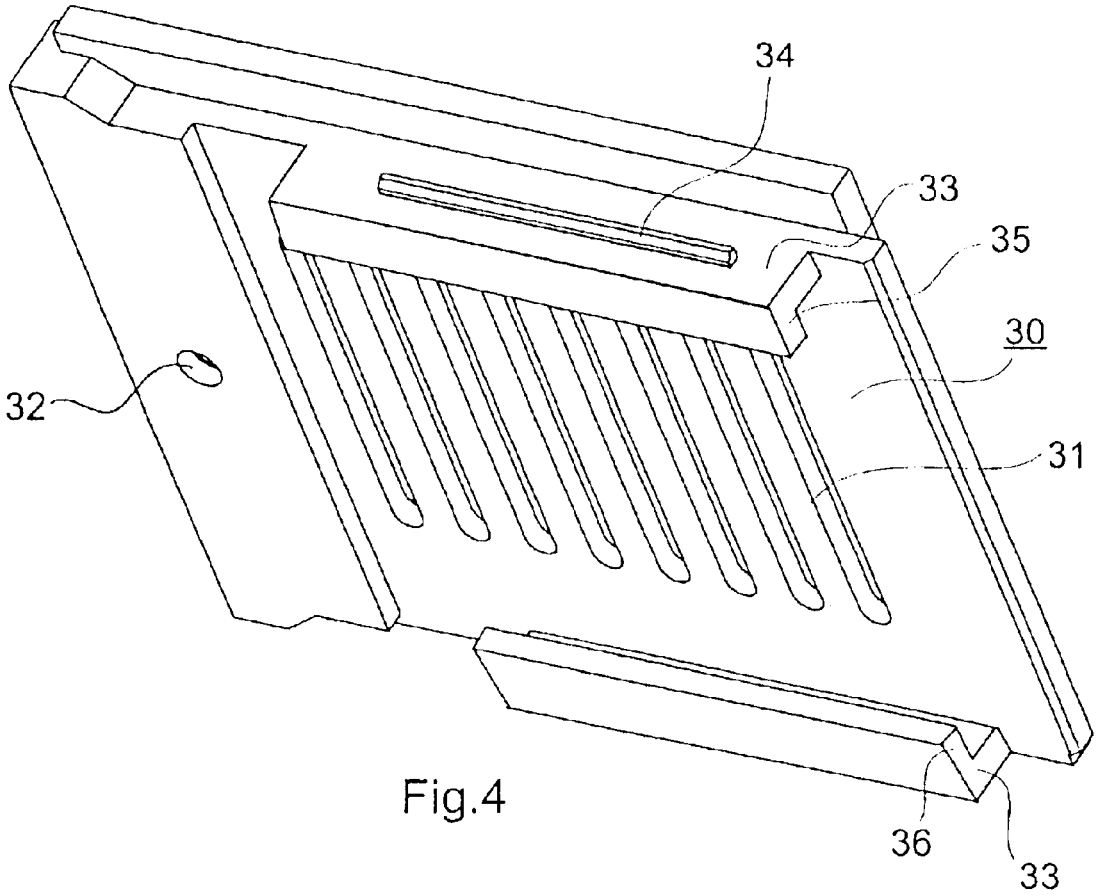
FIG. 4 shows a perspective view of a further embodiment of a cover for an arc quenching device according to the invention.

FIG. 4 shows a perspective view of a further embodiment of a cover 30 for an arc quenching device 1 according to the invention. This has outlet openings 31, an aperture opening 32 for an attachment screw which is not illustrated, and molded attachments 33 with projecting webs 34, which are arranged at the side on it, for engaging in slots 13 in the insulating walls 2, 3 of the arc splitter stack 7. In this case, the molded attachments 33 are in the form of guide rails 35, 36 in order to hold the projecting webs 34, and the insert cartridge 37 (FIG. 5) is inserted into these guide rails 35, 36.

Figure 5:
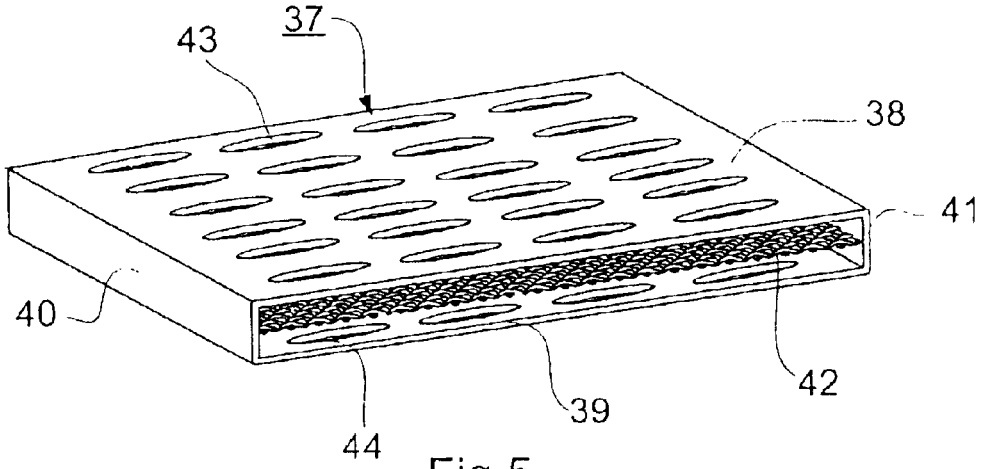
FIG. 5 shows a perspective view of a further embodiment of an insert cassette for an arc quenching device according to the invention.

FIG. 5 shows a perspective view of a further embodiment of an insert cartridge 37 for an arc quenching device 1 according to the invention. This includes a covering panel 38, a base panel 39 and side walls 40, 41, which form a cavity for the insertion of metal sieves 42 as deionization technology. Aperture openings 43, 44, which are in the form of slots in this embodiment, are provided in the flow direction of the switching gases in the covering panel 38 and in the base panel 39.

The insert cartridge according to the invention can be installed very easily when required, and does not result in any increase in the physical volume of the circuit breaker.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An arc quenching device for an air-switching low-voltage switching device, comprising:

a quenching chamber which has quenching plates and a cover for covering the quenching chamber, the cover being provided with outlet openings for switching gases, wherein the quenching chamber includes means for accommodating an optionally usable separate cooling device that includes a sieve for the switching gases, wherein the optionally usable separate cooling device is in the form of a frame for accommodating the sieve and is suitable for installation in an interior of the arc quenching device, between the quenching plates and the cover, with the quenching plates being supported independently of the cover, wherein the optionally usable cooling device has a covering panel and a base panel added to it to form an insert cartridge, the insert cartridge forms a cavity for the introduction of the sieve, and wherein aperture openings are provided for the switching gases in the covering panel and in the base panel.

2. The arc quenching device as claimed in claim 1, wherein the aperture openings have one of a circular and polygonal cross section.

3. The arc quenching device as claimed in claim 1, wherein the aperture openings are in the form of slots.

4. The arc quenching device as claimed in claim 1, wherein the means for accommodating includes an attachment device and wherein the optionally usable cooling device and the cover of the arc quenching device are each provided with interacting attachment devices on a side facing the quenching plates, the optionally usable cooling device being fitable to the arc quenching device by way of the attachment devices on the inside of the cover, before the cover is installed on the arc quenching device.

5. The arc quenching device as claimed in claim 4, wherein the attachment devices are in the form of holding openings in the cover of the arc quenching device and attachment pins, the attachment pins being arranged on the covering panel of the insert cartridge for insertion into said holding openings.

6. The arc quenching device as claimed in claim 5, wherein dimensions of the holding openings and the attachment pins are matched to one another, whereby when the attachment pins are inserted into the holding openings, a friction fit is produced.

7. The arc quenching device as claimed in claim 6, wherein the attachment pins are slotted and sprung in order to produce the friction fit.

8. The arc quenching device as claimed in claim 5, wherein the attachment devices on the cover are in the form of molded attachments and guide rails.

9. The arc quenching device as claimed in claim 2, wherein the aperture openings are in the form of slots.

10. The arc quenching device as claimed in claim 1, wherein the sieve is one of a metal mesh or a metal sieve.

11. The arc quenching device as claimed in claim 2, wherein the sieve is one of a metal mesh and a metal sieve.

12. The arc quenching device as claimed in claim 3, wherein the sieve is one of a metal mesh and a metal sieve.

13. The arc quenching device as claimed in claim 1, wherein the quenching plates and the cover are attached to common insulating panels, the common insulating panels being arranged parallel to one another and for holding the quenching plates and the cover between them, wherein the cover further includes molded attachments having webs which project outward, the webs being for insertion into slots arranged in the insulating panels.

14. The arc quenching device as claimed in claim 4, wherein the quenching plates and the cover are attached to common insulating panels, the common insulating panels being arranged parallel to one another and for holding the quenching plates and the cover between them, wherein the cover further includes molded attachments having webs which project outward, the webs being for insertion into slots arranged in the insulating panels.

15. The arc quenching device as claimed in claim 5, wherein the quenching plates and the cover are attached to common insulating panels, the common insulating panels being arranged parallel to one another and for holding the quenching plates and the cover between them, wherein the cover further includes molded attachments having webs which project outward, the webs being for insertion into slots arranged in the insulating panels.

16. The arc quenching device as claimed in claim 6, wherein the quenching plates and the cover are attached to common insulating panels, the common insulating panels being arranged parallel to one another and for holding the quenching plates and the cover between them, wherein the cover further includes molded attachments having webs which project outward, the webs being for insertion into slots arranged in the insulating panels.

* * * * *